US006293733B1

(12) United States Patent
Tezuka

(10) Patent No.: US 6,293,733 B1
(45) Date of Patent: Sep. 25, 2001

(54) LOW-DEPTH WATER BOTTOM OBSERVING SYSTEM

(76) Inventor: George Tezuka, 1-13-4-206 Higashi-Komagata Sumida-ku, Tokyo 130-0005 (JP)

( * ) Notice: Subject to any disclaimer, the term of this patent is extended or adjusted under 35 U.S.C. 154(b) by 0 days.

(21) Appl. No.: 09/560,850

(22) Filed: Apr. 28, 2000

(51) Int. Cl.[7] ..... B63C 11/00
(52) U.S. Cl. ..... 405/185; 114/362; 128/201.27
(58) Field of Search ..... 405/185, 186, 405/188; 114/362; 128/201.27, 201.29, 201.11, 206.24, 206.26

(56) References Cited

U.S. PATENT DOCUMENTS

| | | | | |
|---|---|---|---|---|
| 1,331,819 | * | 2/1920 | Matheny | 128/201.27 |
| 1,561,086 | * | 11/1925 | Korjibski | 128/206.24 |
| 3,425,231 | * | 2/1969 | Rehrer | 405/185 |
| 3,880,157 | * | 4/1975 | Elifritz | 128/142.7 |
| 3,906,734 | * | 9/1975 | Pogonowski et al. | 61/46 |
| 4,208,152 | * | 6/1980 | Colston | 405/186 |
| 4,674,493 | * | 6/1987 | Mitchell | 128/202.14 |
| 5,143,174 | * | 9/1992 | Davis | 182/151 |
| 5,219,368 | * | 6/1993 | Page | 2/413 |
| 6,021,733 | * | 2/2000 | Jaramillo, Sr. | 114/362 |

* cited by examiner

*Primary Examiner*—Thomas B. Will
*Assistant Examiner*—Raymond W. Addie
(74) *Attorney, Agent, or Firm*—Hedman & Costigan, P.C.

(57) ABSTRACT

A low-depth water bottom observing system in which at least one guide person monitors divers underwater includes a diving base boat equipped with a deck; an air supply system equipped with a plurality of air supply shut-off valves; a plurality of diving helmets; a plurality of air tubes which connect the diving helmets to the air supply shut-off valves; an air supply source which is connected to the air supply system; a step portion equipped with a non-slip platform, the step portion being pivotally mounted to the gunwale of the diving base boat to enable the step portion to be rotated between a first position in which the step portion is stored on the deck of the diving base boat, and a second position in which the step portion is positioned slightly above the surface of the water; a diving region frame arranged on the water bottom, the diving region frame including a peripheral arrangement of pipe anchors to hold the diving region frame to the water bottom, and at least one guide rope provided around upper portions of the pipe anchors to partition off a diving region; a ladder which hangs down from the step portion to enable divers to descend down into the diving region frame from the diving base boat; at least one securing anchor fixed to the water bottom within the diving region frame; and at least one securing rope for securing the ladder to the securing anchor.

3 Claims, 10 Drawing Sheets

LOW-DEPTH WATER BOTTOM OBSERVING SYSTEM

BACKGROUND OF THE INVENTION

1. Field of the Invention

The present invention relates to a diving system for observing the water bottom at low depths.

2. Description of the Prior Art

Up to the present time, water diving has been carried out using a diving mask and snorkel (i.e., a breathing tube approximately 30 cm in length, in which one end of the breathing tube is held in the diver's mouth and the other end is kept above the surface of the water), or scuba-diving equipment. However, such techniques require special training and equipment in order to observe formations such as coral reefs or the like lying at depths of around 5 m, and for this reason such methods are not suited to people desiring a simple viewing experience.

In order to solve this problem, various systems have been proposed, and examples include those systems disclosed in U.S. Pat. Nos. 5,079,775, 5,193,530 and 5,471,976.

SUMMARY OF THE INVENTION

In view of the problems of the prior art mentioned above, it is a first object of the present invention to provide a low-depth water bottom observation system which makes it possible for divers to observe the water bottom within a diving region without having to be accompanied by a guide person.

It is a second object of the present invention to provide a low-depth water bottom observation system which makes it possible for the divers to individually decide when to descend to the diving region and when to ascend to a diving base boat.

It is a third object of the present invention to provide a low-depth water bottom observation system which makes it possible for people who are waiting their turn to dive to use the open helmets that become available as individual divers return to the diving base boat.

It is a fourth object of the present invention to provide a low-depth water bottom observation system which makes it possible for the divers to easily wear diving helmets.

It is a fifth object of the present invention to provide a low-depth water bottom observation system equipped with a step portion which can be stored on the deck of the diving base boat when the diving helmets are not being used in order to prevent the step portion from becoming a hindrance to the cruising of the diving base boat.

It is a sixth object of the present invention to provide a low-depth water bottom observation system equipped with a step portion which makes it possible for divers to safely descend into the water and ascend out of the water.

It is a seventh object of the present invention to provide a low-depth water bottom observation system which makes it possible to prevent tides and the like from lowering the safety of the diving base boat and divers when the diving base boat is stopped at a location for diving.

In order to achieve these objects, the low-depth water bottom observation system according the present invention includes a diving base boat equipped with a deck; an air supply system equipped with a plurality of air supply shut-off valves; a plurality of diving helmets; a plurality of air tubes which connect the diving helmets to the air supply shut-off valves; an air supply source which is connected to the air supply system; a step portion equipped with a non-slip platform, the step portion being pivotally mounted to the gunwale of the diving base boat to enable the step portion to be rotated between a first position in which the step portion is stored on the deck of the diving base boat, and a second position in which the step portion is positioned slightly above the surface of the water; a diving region frame arranged on the water bottom, the diving region frame including a peripheral arrangement of pipe anchors to hold the diving region frame to the water bottom, and at least one guide rope provided around upper portions of the pipe anchors to partition off a diving region;

a ladder which hangs down from the step portion to enable divers to descend down into the diving region frame from the diving base boat; at least one securing anchor fixed to the water bottom within the diving region frame; at least one securing rope for securing the ladder to the securing anchor; and at least one guide person for monitoring the divers as they move around the diving region frame and for monitoring the divers as they move between the diving base boat and the diving region frame.

In this low-depth water bottom observation system, because the divers stay within the diving region frame, the safety of the divers is ensured, and for this reason there is no need for the divers to be accompanied by a guide person as they move around. Accordingly, the first object of the present invention is achieved. Further, by keeping the divers within a prescribed diving region, the diving region frame prevents the divers from damaging formations such as coral reefs lying outside the diving region, whereby the surrounding environment is preserved. Preferably, an annular grating (preferably made of aluminum) is arranged on the water bottom around the inner periphery of the diving region frame to prevent the divers from being injured and to prevent the divers from trampling the water bottom inside the diving region frame.

Further, because the ladder hangs down from the diving base boat into the diving region frame, it is possible for individual divers to freely move between the diving base boat and the diving region frame. Accordingly, the second object of the present invention is achieved. Furthermore, because individuals returning to the diving base boat create open helmets which can be used by people waiting their turn to dive, efficient use is made of the diving helmets, and this achieves the third object of the present invention.

Further, in the case where a diver (such as a woman or child) has narrow shoulders, an adapter pad is preferably provided between the bottom opening of the diving helmet and the diver's shoulders. In this way, the fourth object of the present invention is achieved. Furthermore, because the load of the diving helmet is evenly placed on the shoulders, the burden on the diver is reduced.

Further, by pivotally mounting the step portion to the gunwale of the diving base boat, it becomes possible to store the step portion on the deck of the diving base boat when the diving helmets are not being used, and lower the step portion to a position slightly above the surface of the water when the diving helmets are being used. Accordingly, the fifth object of the present invention is achieved.

Further, by providing the step portion with a non-slip platform, it is possible to ensure the safety of divers as they descend into the water or ascend out of the water. Accordingly, the sixth object of the present invention is achieved. Furthermore, the non-slip platform is preferably provided with a plurality of water drainage holes to further achieve the sixth object of the present invention.

Further, by securing the ladder to anchors with ropes, it is possible to prevent tides and the like from lowering the safety of the diving base boat and divers when the diving base boat is stopped at a location for diving. Accordingly, the seventh object of the present invention is achieved.

Now, without the need for a special course and license, the average layman can use the low-depth water bottom observation system according to the present invention to safely enjoy water bottom observations with ease for a low fee after a brief training period involving only simple directions.

Moreover, because people who are waiting to dive can take their turn when helmets become open as individual divers return to the diving base boat, the number of divers is not limited by the number of helmets. Further, a larger air supply system can be used when more helmets are needed.

Furthermore, because the divers can safely move around the diving region frame with ease, there is no need for actual guidance. Accordingly, safe operations can be ensured so long as at least one guide person is stationed on the diving region frame.

DETAILED DESCRIPTION OF THE PREFERRED EMBODIMENTS

A detailed description of the preferred embodiment of the present invention will now be described with reference to the appended drawings. First, the structure of the present invention will be described.

Figure 1:
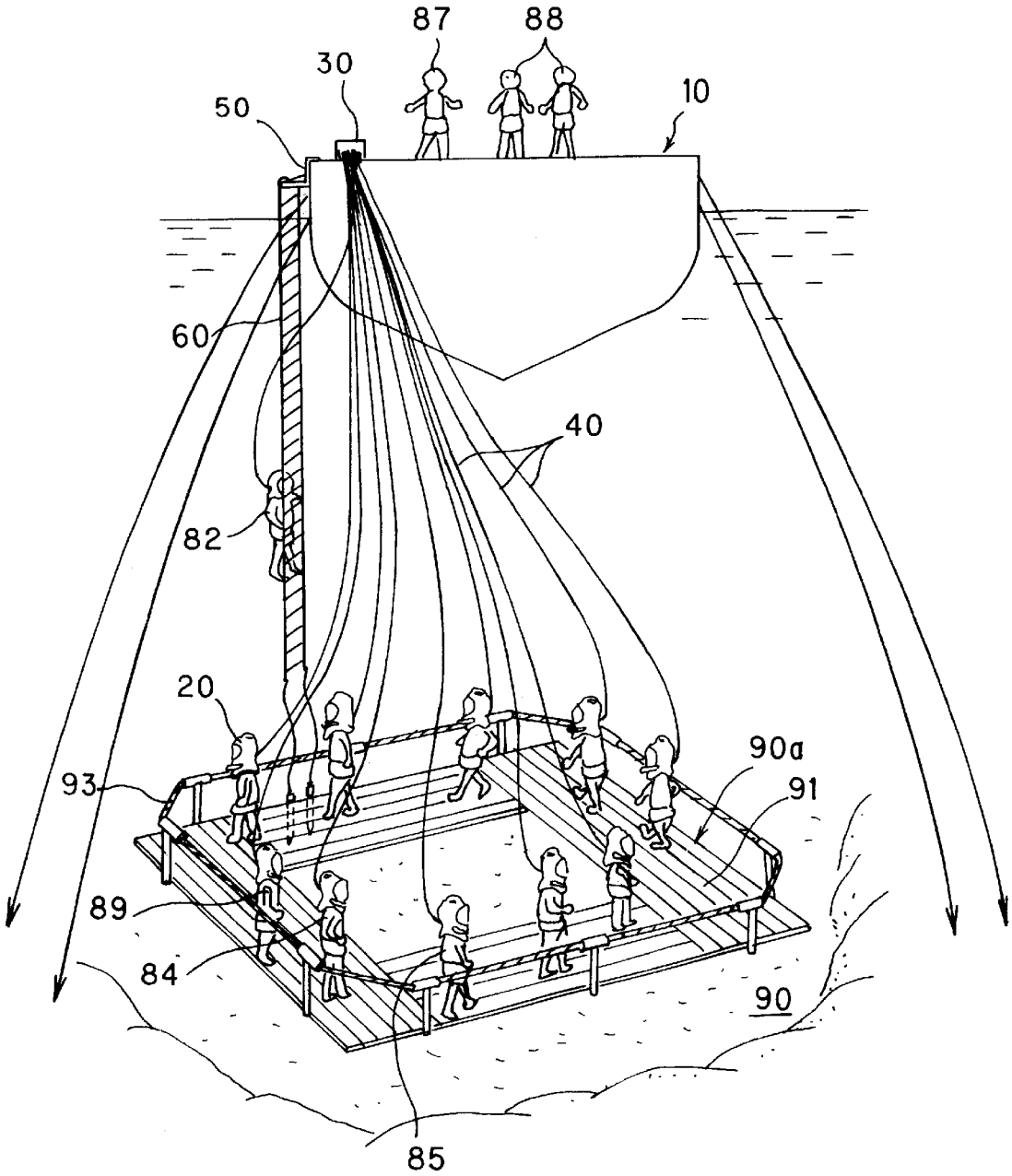
FIG. 1 is a diagram showing the overall structure of the low-depth water bottom observation system according to the present invention.

Namely, as shown in FIG. 1, the low-depth water bottom observing system according to the preferred embodiment of the present invention is comprised of a diving base boat 10, diving helmet portions 20, an air supply system portion 30, air tubes 40 which connect the diving helmets 20 with the air supply system 30, a step portion 50, a ladder portion 60, a diving region frame portion 90*a*, and observation guides 89.

The air supply system portion 30 and the step portion 50 are provided on the diving base boat 10.

Figure 2:
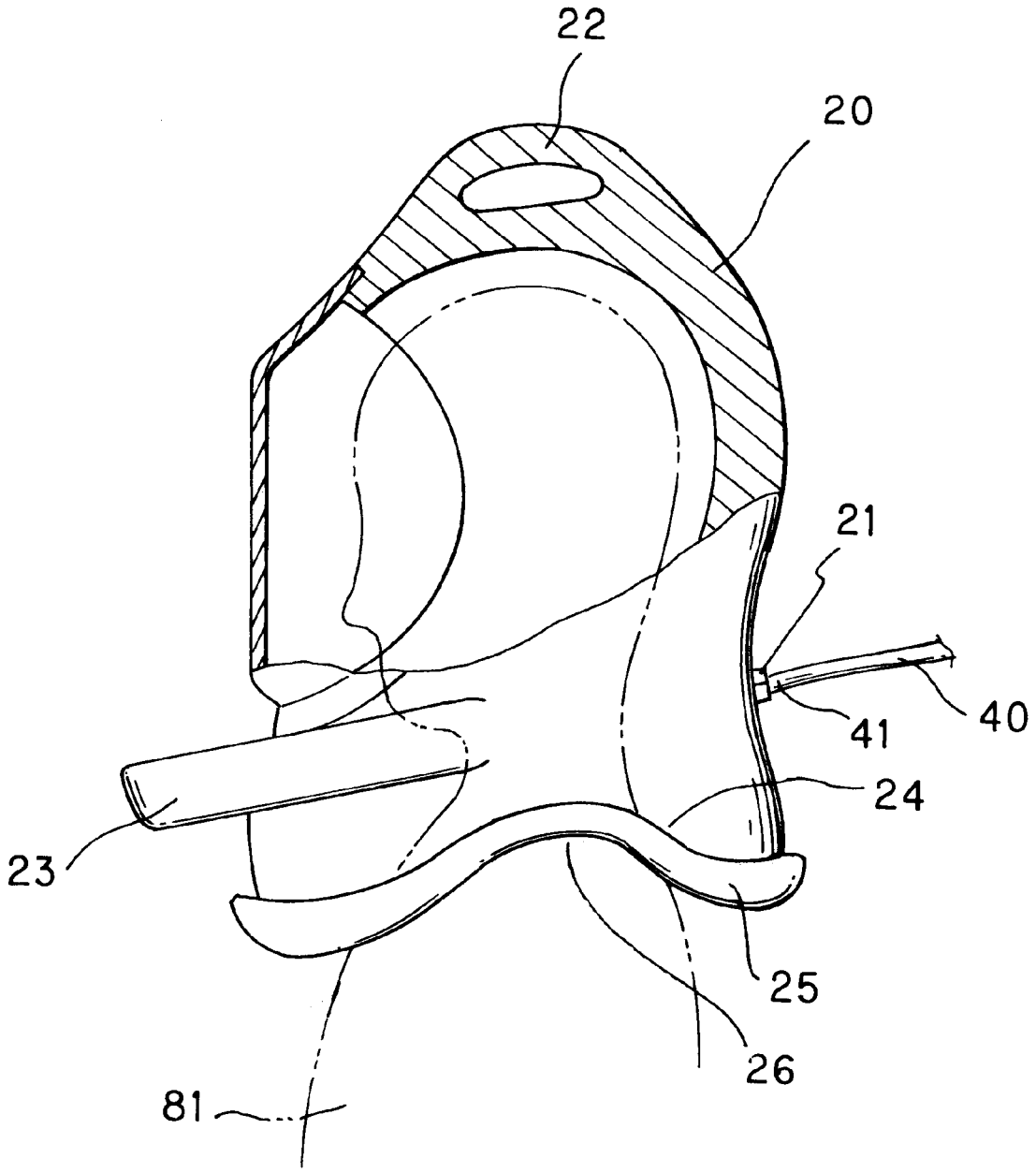
FIG. 2 is a side view showing a diving helmet worn by a diver.

As shown in FIG. 2, a diver 81 wears one of the diving helmets 20. Each of the diving helmets 20 is provided with an air inlet port 21 which is connected to one end 41 of one of the air tubes 40 to enable air to be supplied to the diving helmet 20. Further, a handle 22 is provided on the top portion of the diving helmet 20, and a handle 23 is provided on the front portion of the diving helmet 20. In the case of normal shoulder width (not shown in the drawings), when the diving helmet is worn by the diver 81, the lower opening portion 24 of the diving helmet 20 is directly supported by the shoulder portions 26 of the diver 81. However, in the case where the diver 81 is a woman or child with narrow shoulders, an adapter pad 25 is provided between the diving helmet 20 and the shoulder portions 26 (which is the case shown in FIG. 2).

Figure 3:
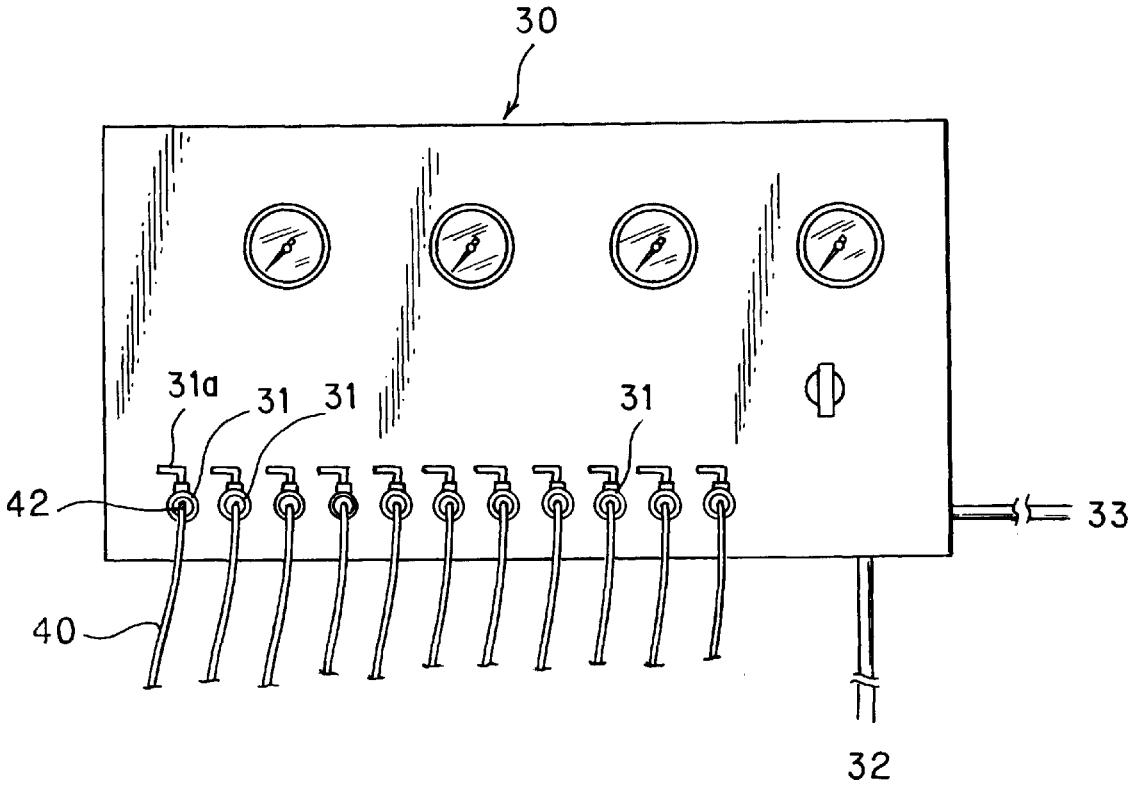
FIG. 3 is diagram showing the air supply system equipped with air supply shut-off valves.

As shown in FIG. 3, the air supply system 30 is equipped with a plurality of air supply shut-off valves 31, and the other ends 42 of the air tubes 40 are connected to these air supply shut-off valves 31. In this regard, the number of diving helmets 20 depends on the number of air supply shut-off valves 31, and in the present embodiment there are eleven air supply shut-off valves 31. Accordingly, the maximum number of divers depends on the number of diving helmets 20. Further, in order to supply air to the diving helmets, the air supply system 30 is equipped with a pressure compressor 32 (not shown in the drawings) and an emergency air tank 33 (not shown in the drawings), and the air supply shut-off valves 31 are opened and closed by knobs 31*a*.

The air tubes 40 have a length of approximately 25 m and are used to connect the diving helmets 20 to the air supply system 30. Preferably, the air tubes are made of resin in order to provide adequate strength and durability for the diameter necessary to reliably maintain air flow.

Figure 4:
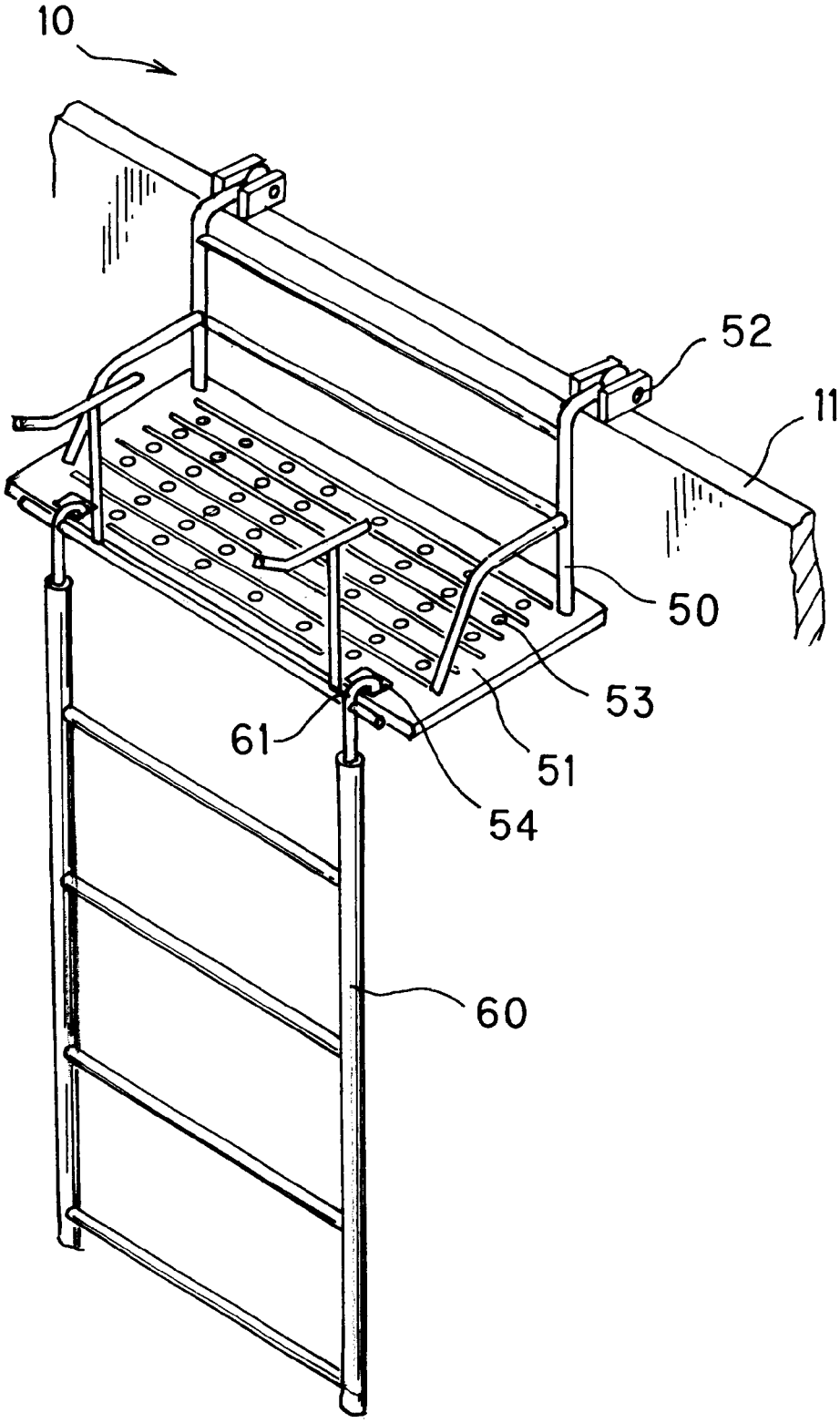
FIG. 4 is a diagram showing the position of the step portion when the step portion is being used by the divers to descend into the water and ascend out of the water.
Figure 5:
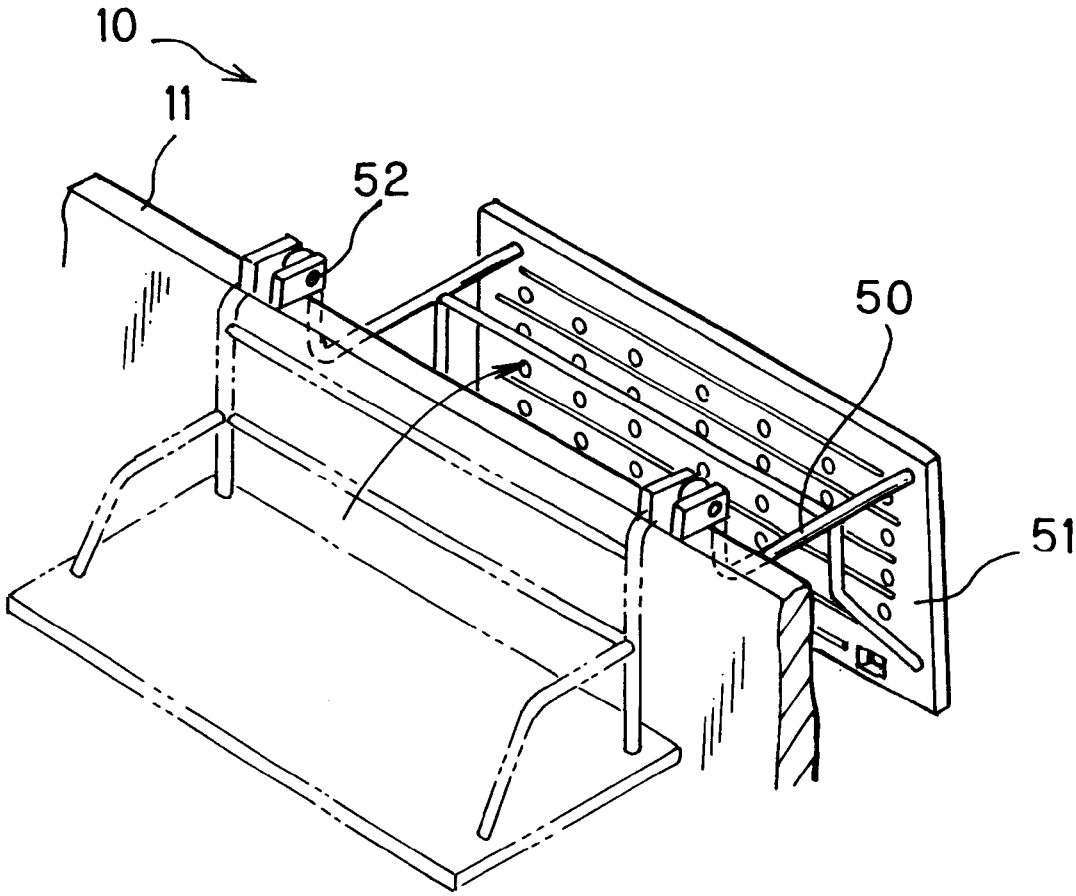
FIG. 5 is a diagram showing the storage position of the step portion when the step portion is not being used.

As shown in FIG. 4, the upper end of the step portion 50 is supported by the gunwale 11 of the diving base boat 10. The step portion 50 is equipped with a non-slip platform 51. Preferably, the platform 51 is provided with holes to achieve good water drainage. As shown in FIG. 5, the upper end 52 of the step portion 50 is pivotally mounted to the gunwale 11 of the diving base boat 10.

Figure 6:
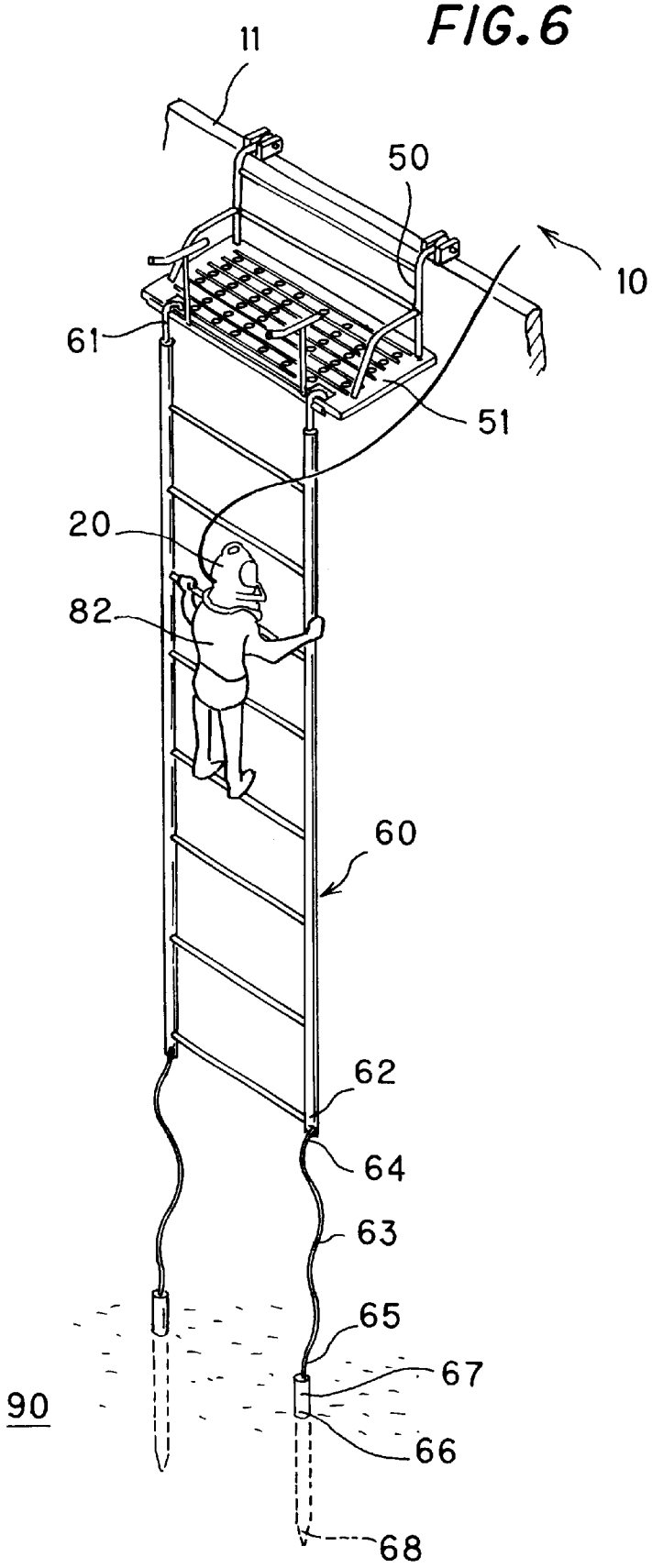
FIG. 6 is a diagram showing how the ladder hangs down from the step portion while being secured to anchors with securing ropes.

As is further shown in FIG. 4, the ladder 60 is provided with hook portions 61 that hook onto the lower end 54 of the step portion 50. As shown in FIG. 6, the ladder 60 hangs down from the lower end 54 of the step portion 50. The lower ends 62 of the ladder 60 are connected to the upper ends 64 of guide ropes 63, and the lower ends 65 of the guide ropes 63 are connected to the upper ends 67 of anchors 66. The lower ends 68 of the anchors 66 are buried in the water bottom 90 (e.g., the sea bottom, lake bottom, etc.). Alternatively, the anchors 66 may be secured to an annular grating member 91 (not shown in FIG. 6) arranged on the water bottom 90. As shown in FIG. 1, the ladder 60 connects the diving base boat 10 with the diving region frame 90*a*.

Figure 8:
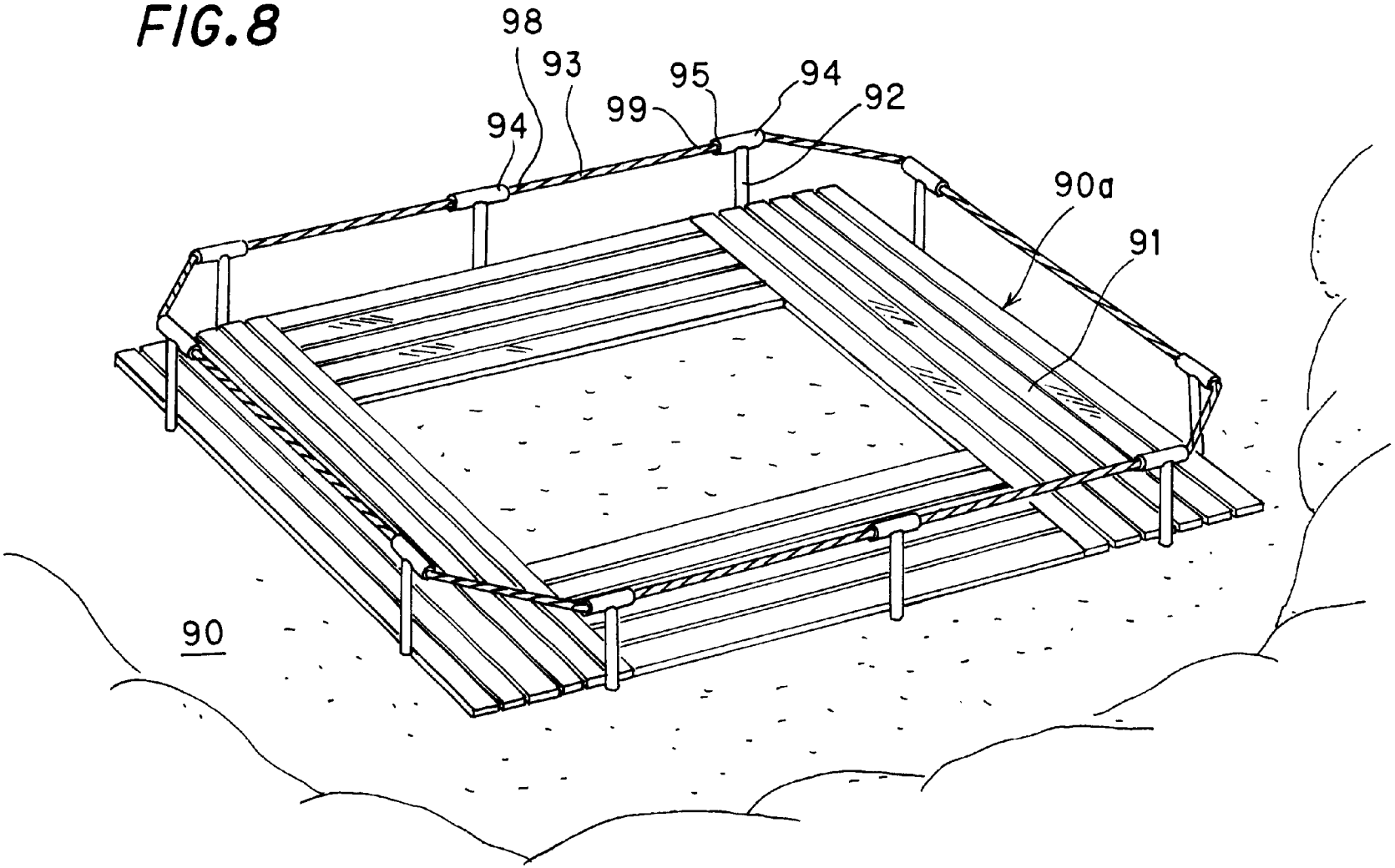
FIG. 8 is a diagram showing the diving region frame equipped with pipe anchors and guide ropes.
Figure 9:
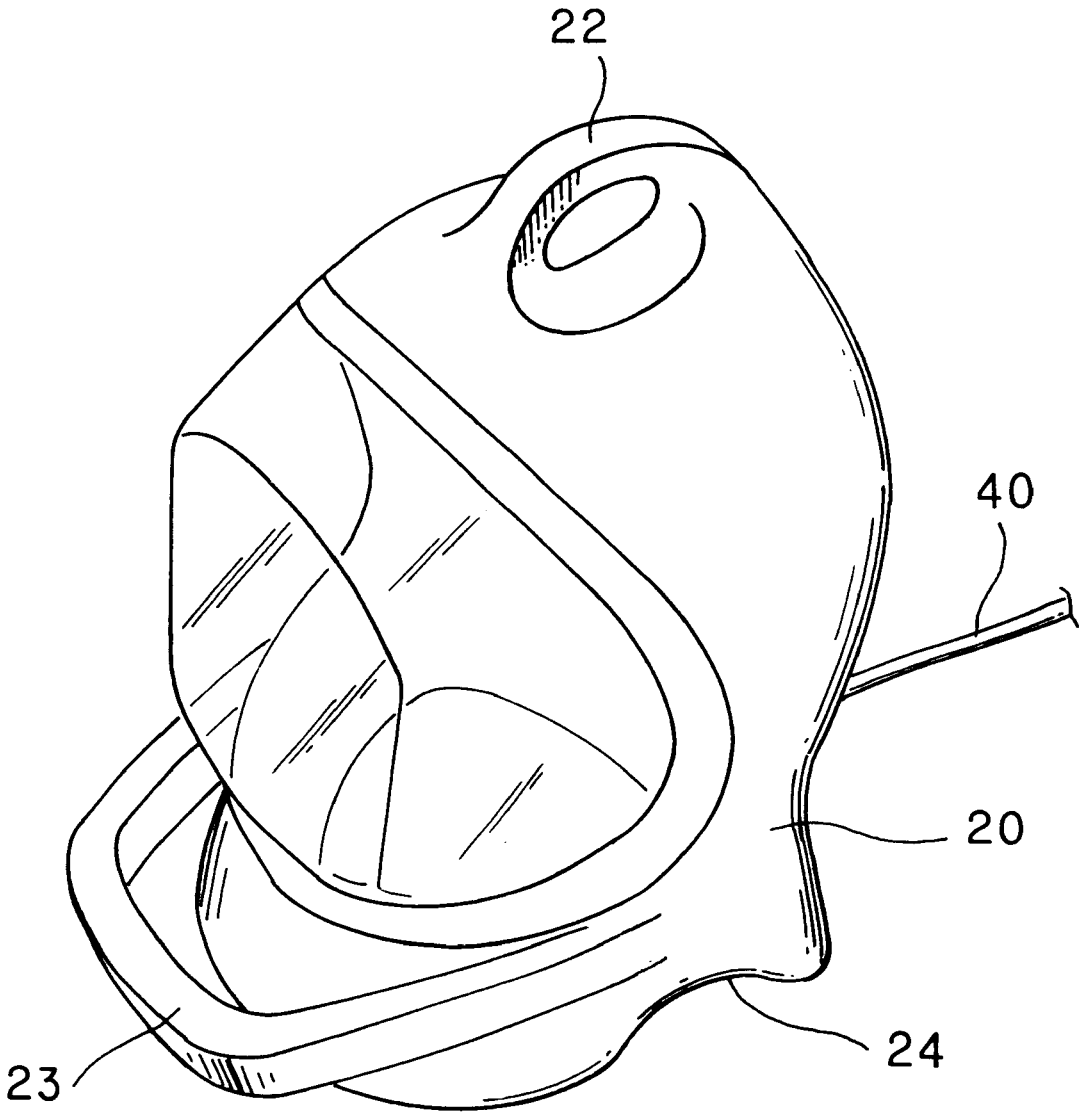
FIG. 9 is a perspective view of a diving helmet.

As shown in FIG. 8, a plurality of pipe anchors 92 are buried in the water bottom 90. The upper ends 97 of the pipe anchors 92 are provided with a left end 94 and a right end 95 which form a T-shaped structure. Further, guide ropes 93 are connected to the pipe anchors 92. Namely, the right ends 98 of the guide ropes 93 are connected to the left ends 94 of the pipe anchors 92, and the left ends 99 of the guide ropes 93 are connected to the right ends 95 of the pipe anchors 92. Accordingly, the plurality of pipe anchors 92 and guide ropes 93 create a partitioned diving region. Alternatively, instead of a plurality of guide ropes 93, it is possible to use one long guide rope which is secured to each of the pipe anchors 92. In other words, the diving region frame 90*a* may be partitioned from the surrounding area by the pipe anchors 92 and one or more guide ropes 93. Preferably, an annular grating member 91 is spread out on the water bottom 90 along the inner periphery of the diving region frame 90*a*. In the present embodiment, the diving region frame 90*a* has a rectangular shape with approximate dimensions of 20 m×10 m, but the present invention is not limited to this arrangement, and it is possible to use any desired shape and dimensions.

Next, the operation of the present invention will be described.

First, the operations carried out on the deck of the diving base boat 10 are as follows. First, a guide person 87 is stationed on the diving base boat 10 to monitor the divers 82 from the deck thereof. This guide person 87 confirms the connections between the diving helmets 20, the air tubes 40 and the air supply system 30. Further, the guide person 87 confirms that air is supplied to the inside of the diving helmets and carries out adjustments on such air flow. In this regard, the air supplied to the diving helmets 20 is turned on or off by opening or closing the knobs 31*a*.

Figure 7:
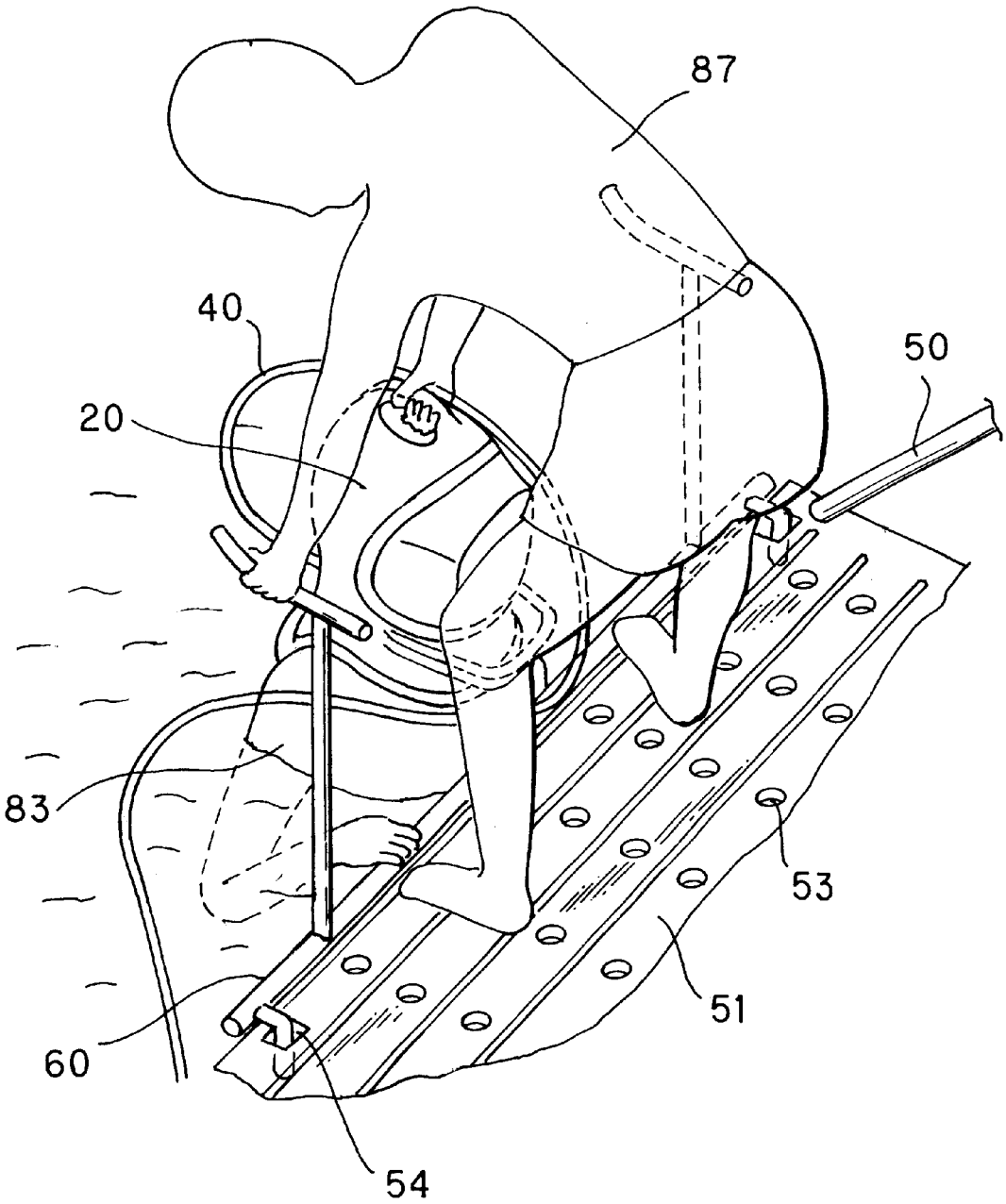
FIG. 7 is a diagram showing how a diving helmet is placed onto the shoulders of a diver when the diver's shoulders reach the water level.
Figure 10:
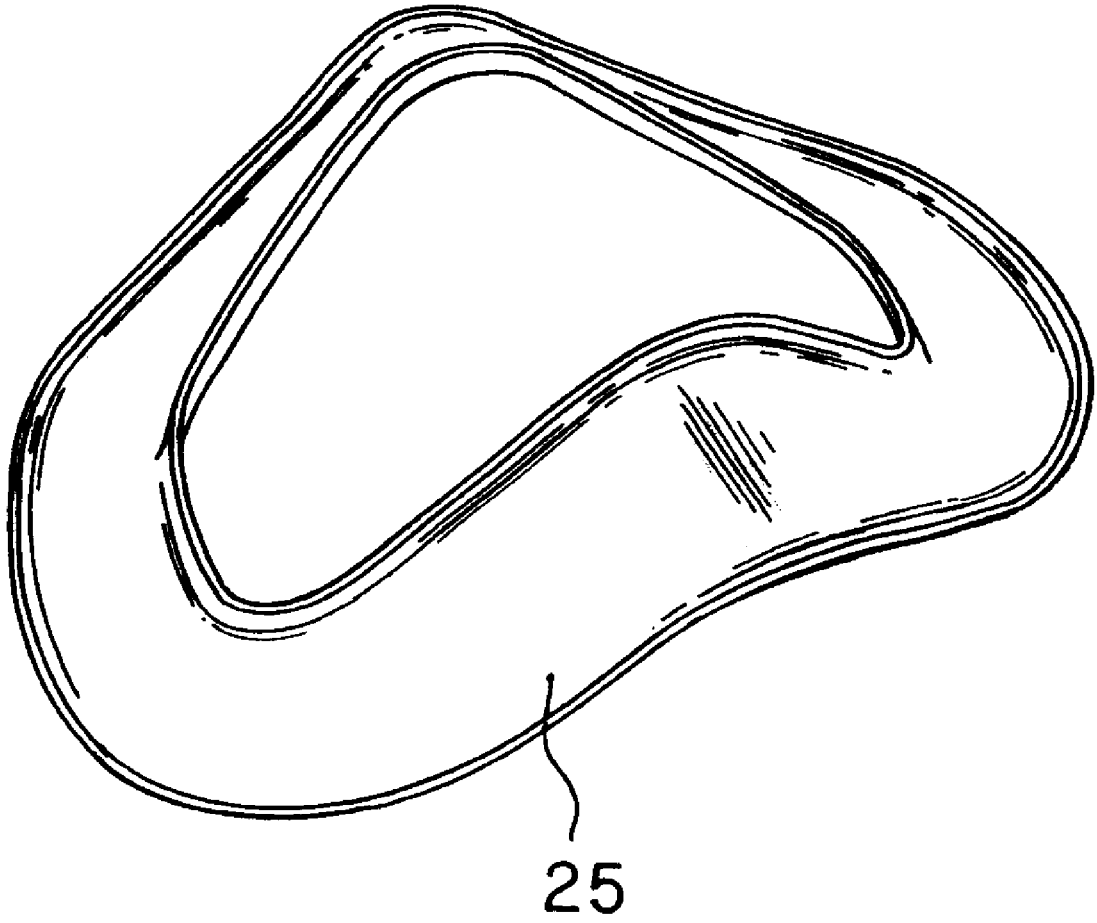
FIG. 10 is a diagram showing the adapter pad used to fit a diving helmet on a diver with narrow shoulders.

Next, with reference to FIGS. 4, 5 and 7, a description will be given for the operations carried out when the divers 83 go under water from the diving base boat 10. First, the divers 83 use the step portion 50 to enter the water from the deck of the diving base boat 10. In this regard, the non-slip platform 51 makes it possible for the divers 83 to safely enter the water. Further, even if waves strike the step portion 50, the plurality of holes provided in the platform 51 enable water to quickly drain therethrough, and this makes it possible for the divers 83 to ascend or descend safely even when water splashes over the step portion 50. Next, as shown in FIG. 7, the guide person 87 on the deck of the diving base boat 10 places a diving helmet 20 over the head of a diver 83 when the shoulders of the diver 83 reach the surface of the water. In this regard, the guide person 87 holds onto the handle 22 of the diving helmet 20 to enable quick placement of the diving helmet onto the diver 83. In this connection, the other handle 23 on the diving helmet 20 (see FIG. 2) is provided to ensure that the diving helmet 20 does not come off the diver 81. In other words, the handle 23 serves to reduce the anxiety of the diver 81. Now, as was described previously above, in the case where the diver 81 is a woman or child with narrow shoulders, the adapter pad 25 shown in FIG. 10 is used as shown in FIG. 2. In this way, it is possible to adjust the diameter of the opening on the lower portion of the diving helmet 20. Further, because this evenly distributes the load of the diving helmet 20 on the shoulders of the diver 81, the burden on the diver 81 is reduced.

Now, as shown in FIG. 4, the step portion 50 is arranged at the surface of the water when in use. On the other hand, when the step portion 50 is not being used, the ladder 60 is removed, and the step portion 50 is pivoted around the upper portion 52 thereof to store the step portion 50 on the deck of the diving base boat 10. In this way, safety can be ensured while the diving base boat 10 is cruising.

Next, with reference to FIG. 6, a description will be given for the operations carried out when the diver 82 uses the ladder 60 to descend to the diving region frame 90*a* after having entered the water. In the present description, the ladder 60 descends to a depth of roughly 5 m. However, the present invention is not limited to this depth, and the ladder 60 can descend to any appropriate depth. Further, as was described previously above, the ladder 60 is secured using the ropes 63 and the anchors 66. In this regard, even when the tides cause the diving base boat 10 to rise or fall, height adjustment is achieved by the ropes 63, and this reduces the impact on the ladder 60. Accordingly, such arrangement makes it possible for the diver 82 to safely reach the diving region frame 90*a*.

Next, with reference to FIGS. 1 and 8, a description will be given for the operations carried out by the divers 84 on the diving region frame 90*a*. Without being accompanied by a guide person, the divers 84 can observe the water bottom 90 while following along the guide ropes 93 or while freely moving about the diving region frame 90*a*. In this connection, a guide person 89 wearing one of the diving helmets 20 is stationed on the diving region frame 90*a* to monitor the divers 84. Namely, the guide person 89 ensures the safety of the divers 82 as they descend down to the diving region frame 90*a* from the diving base boat 10, monitors the divers 84 to make sure they don't move outside the guide ropes 93 of the diving region frame 90*a*, and ensures the safety of the divers 82 as they return to the diving base boat 10. In this regard, the main role of the guide person 89 is to ensure the safety of the divers, and there is no need to carry out actual guidance. Accordingly, safe operations can be ensured so long as at least one guide person 89 is stationed on the diving region frame 90*a*. Further, safety is also ensured by having the divers 84 move along the guide ropes 93 above a grating member 91 (preferably made of aluminum) provided inside the diving region frame 90*a*. Moreover, the provision of the grating member 91 prevents the divers from stepping directly on the water bottom within the diving region frame 90*a*, and this makes it possible to protect the environment of the water bottom. Similarly, by preventing the divers 84 from moving outside the diving region frame 90*a* and trampling the surrounding area, the guide ropes 93 protect the environment of the water bottom surrounding the diving region frame 90*a*.

Lastly, a description will be given for the operations carried out when a diver 84 wishes to end water bottom observations. Namely, when a diver 84 wishes to end water bottom observations, the diver 84 simply climbs up the ladder 60 and returns to the diving base boat 10 by himself or herself without the need for guidance from a guide person. Accordingly, divers 85 who wish to continue observing the water bottom may simply remain on the diving region frame 90*a*. Furthermore, during the time when the divers 84 who have returned to the diving base boat 10 are resting, other divers 88 who have been waiting their turn can use the open helmets to descend to the diving region frame 90*a*.

At this point, it should be noted that the present invention is not limited to the embodiment described above, and it is possible to make various changes and additions without departing from the scope and spirit of the present invention as defined by the appended claims.

As can be understood from the detailed descriptions given above, a list of the effects and advantages of the present invention is as follows:

(1) Without the need for a special course and license, the average layman can safely enjoy water bottom observations with ease for a low fee after a brief training period involving only simple directions.

(2) At a depth of around 5 m, the divers can observe the water bottom by following the guide ropes or by freely moving around the diving region frame.

(3) Divers engaged in water bottom observations can individually decide when to descend to the diving region frame and when to ascend to the diving base boat.

(4) People waiting to dive can take their turn in the order in which open diving helmets become available as individual divers return to the diving base boat from the diving region frame, and because this reduces the waiting time, it becomes possible to make efficient use of the diving base boat.

(5) Because the divers stay within the diving region frame, the safety of the divers is ensured.

(6) Because the divers do not go outside the diving region frame, water bottom formations such as coral reefs do not become damaged, and this makes it possible to preserve the environment.

(7) By providing a grating member inside the diving region frame to prevent the divers from stepping directly on the water bottom within the diving region frame 90*a,* it is possible to preserve the environment. Further, the provision of the grating member makes it possible to prevent the divers from getting injured.

(8) Because the duty of an underwater guide is to monitor the divers on the diving region frame, safe diving can be ensured so long as at least one guide person is stationed on the diving region frame.

(9) By using an adapter pad, the diving helmets can be worn by anyone regardless of their shoulder width, and this reduces the burden on the shoulders of the divers.

(10) By pivotally mounting the step portion to the gunwale of the diving base boat, the step portion can be stored on deck when not is use, and this prevents the step portion from becoming a hindrance when the diving base boat is cruising.

(11) By forming the step portion with a non-slip platform provided with a plurality of water drainage holes, it is possible to improve safety when the divers are descending into the water or ascending out of the water.

(12) Because the ladder is secured to the water bottom using ropes attached to anchors, the diving base boat and the divers are safe.

What is claimed is:

1. A low-depth water bottom observing system in which at least one guide person monitors divers underwater, the system comprising:

a diving base boat equipped with a deck;

an air supply system equipped with a plurality of air supply shut-off valves, the air supply system being provided on the diving base boat;

a plurality of diving helmets;

a plurality of air tubes having first and second ends, the first ends being connected to the air supply shut-off valves, and the second ends being connected to the diving helmets, whereby the diving helmets are supplied with air;

an air supply source which is connected to the air supply system;

a step portion equipped with a non-slip platform, the step portion being pivotally mounted to the gunwale of the diving base boat to enable the step portion to be rotated between a first position in which the step portion is stored on the deck of the diving base boat, and a second position in which the step portion is positioned slightly above the surface of the water;

a diving region frame arranged on the water bottom, the diving region frame including a peripheral arrangement of pipe anchors to hold the diving region frame to the water bottom, and at least one guide rope provided around upper portions of the pipe anchors to partition off a diving region, the diving region frame is able to accept divers of the same number of open helmets, and the divers are able to take turns at using the open helmets and going into the diving region frame to observe the water bottom by following the guide ropes or by freely moving around the diving region frame;

a ladder which hangs down from the step portion to enable divers to descend down into the diving region frame from the diving base boat;

at least one securing anchor fixed to the water bottom within the diving region frame;

at least one securing rope having first and second ends, the first end being connected to the lower end of the ladder, and the second end being connected to the securing anchor.

2. The low-depth water bottom observing system of claim 1, further comprising an annular adapter pad which is arranged between the shoulders of a diver and the bottom opening of the diving helmet to enable the diving helmet to fit divers with narrow shoulders.

3. The low-depth water bottom observing system of claim 1, further comprising an annular grating member provided on the water bottom along the inner periphery of the diving region frame.

* * * * *